US006015303A

United States Patent [19]

Bonilla et al.

[11] Patent Number: 6,015,303

[45] Date of Patent: Jan. 18, 2000

[54] ELECTRICAL RECEPTACLE ASSEMBLY WITH MULTIPLE SITES OF DUAL SNAP-FIT SECUREMENT MEANS

[75] Inventors: Nelson Bonilla, West Haven; Thomas J. Vigorito, Fairfield, both of Conn.

[73] Assignee: Hubbell Incorporated, Orange, Conn.

[21] Appl. No.: 08/953,452

[22] Filed: Oct. 17, 1997

[51] Int. Cl.[7] ..... H01R 4/66

[52] U.S. Cl. ..... 439/107; 439/538

[58] Field of Search ..... 439/107, 731, 439/650, 686, 538

[56] References Cited

U.S. PATENT DOCUMENTS

| | | | |
|---|---|---|---|
| 3,868,161 | 2/1975 | Frantz | 439/107 |
| 4,872,081 | 10/1989 | Murphy et al. | 361/117 |
| 4,872,087 | 10/1989 | Brant | 361/356 |
| 4,939,615 | 7/1990 | Brant et al. | 361/42 |
| 5,472,350 | 12/1995 | Mehta | 439/107 |
| 5,510,760 | 4/1996 | Marcou et al. | 335/18 |
| 5,594,205 | 1/1997 | Cancellieri et al. | 439/538 |
| 5,613,874 | 3/1997 | Orlando et al. | 439/491 |

*Primary Examiner*—Paula Bradley
*Assistant Examiner*—Katrina Davis
*Attorney, Agent, or Firm*—Jerry M. Presson; Michael R. Swartz

[57] ABSTRACT

An electrical receptacle assembly includes a housing and a plurality of dual snap-fit securement arrangements defined on the housing. The housing include a front cover and a back cover being adapted to interfit with the front cover in a mating relationship so as to define an interior cavity for enclosing electrical components. Each dual snap-fit securement arrangement includes a lug attached on one of the front and back covers of the housing, and a pair of latching tabs attached on the other of the front and back covers and disposed in a latching position relative to one another in which the latching tabs are adapted to make interlocking engagement with the lug upon interfitting of the front and back covers into the mating relationship with one another.

16 Claims, 5 Drawing Sheets

ELECTRICAL RECEPTACLE ASSEMBLY WITH MULTIPLE SITES OF DUAL SNAP-FIT SECUREMENT MEANS

CROSS-REFERENCE TO RELATED APPLICATION

Certain subject matter disclosed in this application relates to the invention claimed in a copending patent application entitled "Multi-Contact Electrical Terminal For Electrical Receptacle Assembly" (Docket No. 860-54), designated Ser. No. 08/953,451, filed Oct. 17, 1997, which is assigned to the same assignee as this application.

BACKGROUND OF THE INVENTION

1. Field of the Invention

The present invention generally relates to electrical receptacle assemblies and, more particularly, is concerned with an electrical receptacle assembly with multiple sites of dual snap-fit securement means.

2. Description of the Prior Art

Heretofore, many electrical receptacles manufactured and marketed by Hubbell Incorporated of Orange, Conn., the assignee of the subject application, have employed a housing, which is formed by separate mateable front and back covers, and a mounting bridge having opposite ends with ears attachable to a suitable structure, such as a building wall, by use of suitable fasteners, such as screws or the like, which are employed to hold the housing in a mounted relationship relative to the structure. In some electrical receptacle designs, the mounting bridge has a generally U-shape so as to wrap around portions of the mated front and back covers of the housing and provides securement elements which interlock with complementary securement elements on the front and back covers so as to retain the housing in an assembled condition. In other electrical receptacle designs, the mounting bridge is a relatively flat shape and disposed between the mated front and back covers of the housing with separate mechanical fasteners, such as screws or rivets, used to secure the front and back covers of the housing together.

With respect to these latter electrical receptacle designs, it would be desirable to achieve a rapid, firm and tight securement between front and back covers of the housing and with the flat mounting strap sandwiched therebetween without the use of separate mechanical fasteners or tools. Various designs of snap-fit type securements are known in the prior art. For example, several designs of snap-fit securements of housing parts in electrical receptacles are disclosed in U.S. Pat. No. 4,872,087 to Brant and U.S. Pat. No. 5,510,760 to Marcou et al. A design of a snap-fit securement of an accessory strip to a outlet cover plate is disclosed in U.S. Pat. No. 5,613,874 to Orlando et al. While these prior art snap-fit securement designs may appear to be satisfactory for the specific purposes for which they were designed, they are not seen as providing an optimum solution to the achievement of a rapid and firm assembly of the housing parts that will tightly hold them together in a desired mated relationship, which is the receptacle assembly design problem at hand.

Consequently, a need still remains for a snap-fit securement design for an electrical receptacle assembly which provides a solution to the aforementioned problem without introducing any new problems in place thereof.

SUMMARY OF THE INVENTION

The present invention provides an electrical receptacle assembly incorporating an improved housing parts securement arrangement designed to satisfy the aforementioned needs. The arrangement incorporated by the electrical receptacle assembly of the present invention provides multiple sites of dual snap-fit securement means. These multiple sites of dual snap-fit securement permit achievement of rapid and firm assembly of the receptacle housing parts in a manner that will tightly hold and retain them together in the desired mated relationship.

Accordingly, the present invention is directed to an electrical receptacle assembly which comprises: (a) a housing including a front cover and a back cover being adapted to interfit with one another in a mating relationship so as to define an interior cavity for enclosing electrical components; and (b) a plurality of dual snap-fit securement means provided on the housing. Each of the plurality of dual snap-fit securement means includes a lug attached on one of the back and front covers of the housing and a pair of latching tabs attached on the other of the back and front covers. The latching tabs of each dual snap-fit securement means are disposed in a latching position relative to one another in which the latching tabs are adapted to make interlocking engagement with the lug of the respective dual snap-fit securement means upon interfitting of the front and back covers into the mating relationship with one another.

More particularly, the lug has first and second ends and a pair of opposite side surfaces spaced apart and facing away from one another and extending from the first end to the second end of the lug. The latching tabs have respective body portions fixedly attached on the other of the front and back covers and extending outwardly therefrom toward the one of the front and back covers and respective outer end portions on the respective body portions adapted to interlock with the lug when the one of the front and back covers is interfitted with the other of the front and back covers. The respective outer end portions of the latching tabs are aligned with respective ones of the opposite side surfaces of the lug so that the respective outer end portions of the latching tabs will initially engage the opposite side surfaces of the lugs at the first end thereof as the front and back covers are being interfitted with one another and the latching tabs are making latching engagement with the lug. The respective body portions of the latching tabs are resiliently bendable away from the latching position in which the outer end portions of the latching tabs making latching engagement with said lug are spaced apart from one another through a distance shorter than a distance between the opposite side surfaces of the lug at the second end thereof.

The opposite side surfaces of the lug are closer to one another at the first end of the lug than at the second end thereof such that the opposite side surfaces of the lug extend from the first end to the second end of the lug in a diverging relationship which produces camming actions against the respective outer end portions of the latching tabs after the outer end portions initially engage the opposite side surfaces of the lugs at the first end thereof as the front and back covers are being interfitted with one another. The camming actions cause the respective body portions of the latching tabs to bend away from one another and the respective outer end portions thereof to spread apart from one another through a distance greater than the distance between the opposite side surfaces of the lug at the second end thereof and thereby allow the lug to move between and past the respective outer end portions of the latching tabs toward the other of the front and back covers as the front and back covers are interfitted in the mating relationship with one another.

The lug has respective ledges provided at the second end thereof extending transversely to the opposite side surfaces thereof. The respective outer end portions of the latching tabs have respective latching surfaces thereon which are brought into an overlapping relationship with the respective ledges of the lug to provide the interlocking relationship of the latching tabs with the lug as the respective outer end portions of the latching tabs return to the latching position once the lug has moved past the respective outer end portions of the latching tabs as the front and back covers are interfitted in the mating relationship with one another. Each of the dual snap-fit securement means also includes a sleeve attached on the one of the front and back covers of the housing and surrounding the lug and spaced outwardly from the opposite side surfaces thereof so as to define respective guide passages adjacent to the side surfaces for receiving the latching tabs. The plurality of dual snap-fit securement means having the above-defined constructions allow the front and back covers of the housing to be tightly held and retained together in the mated relationship.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
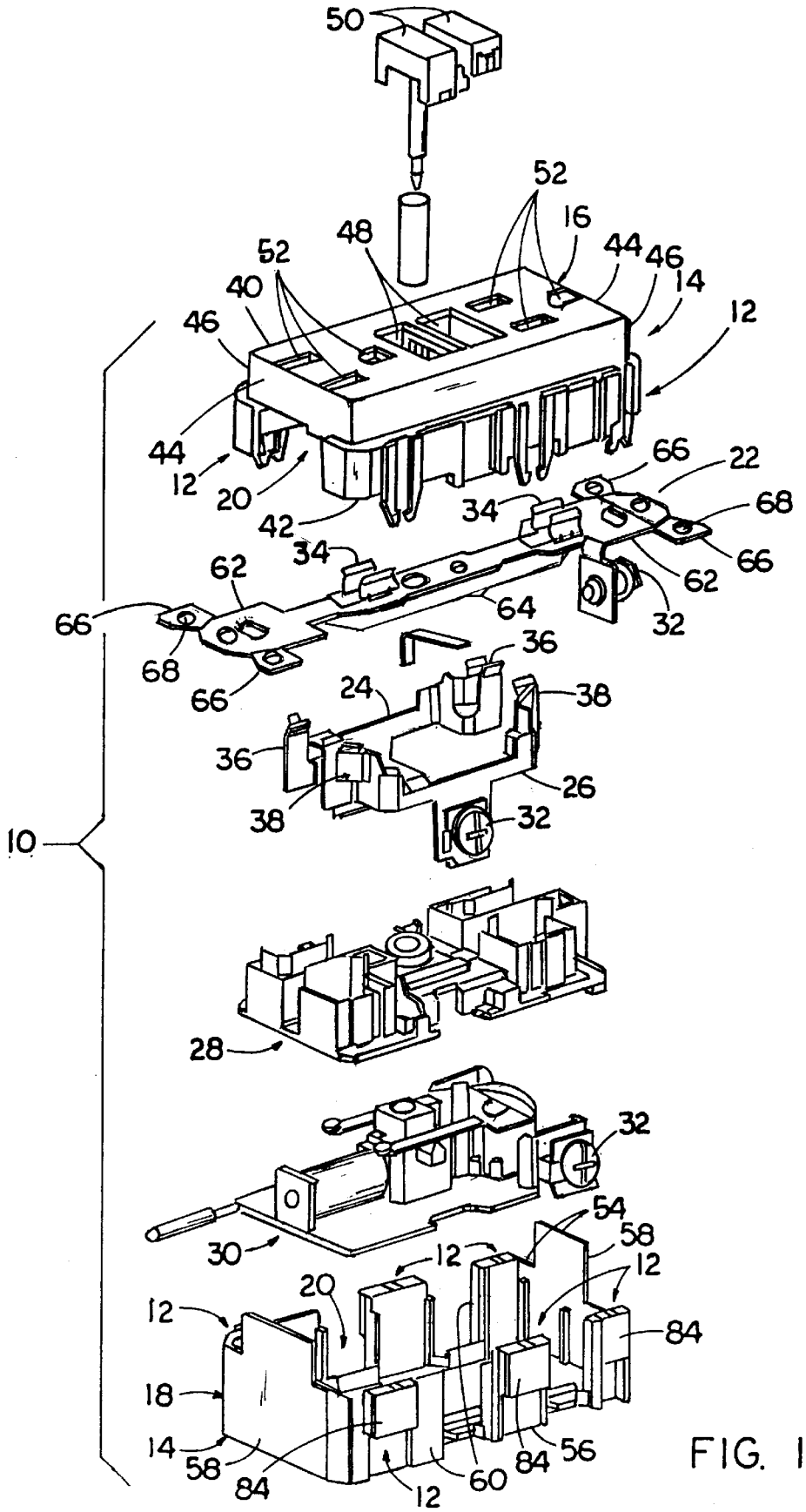
FIG. 1 is an exploded perspective view of an electrical receptacle assembly employing a plurality of dual snap-fit securement means in accordance with the present invention.

In the following description, like reference characters designate like or corresponding parts throughout the several views. Also in the following description, it is to be understood that such terms as "forward," "rearward," "left," "right," "upwardly," "downwardly," and the like, are words of convenience and are not to be construed as limiting terms.

Figure 13:
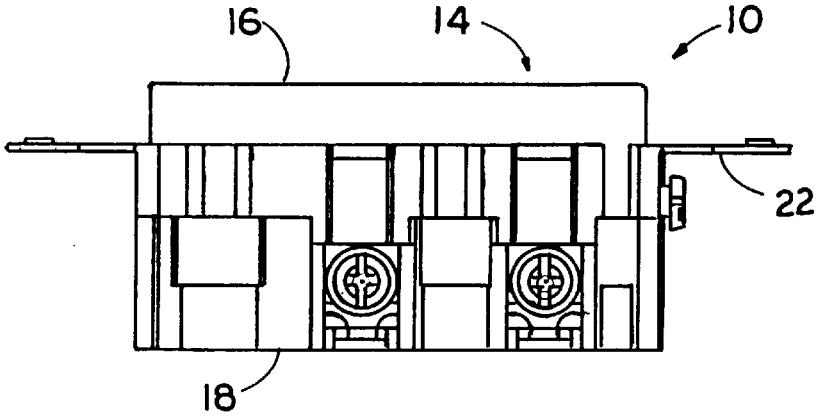
FIG. 13 is a side elevational view of the front and back covers of the housing of FIG. 1 shown in an assembled condition.

Referring now to the drawings, and particularly to FIGS. 1 and 13, there is illustrated an electrical receptacle assembly, generally designated 10, employing a dual snap-fit securement means 12 at a plurality of sites thereon in accordance with the present invention. The plurality of dual snap-fit securement means 12 can be used in electrical receptacle assemblies adapted for various applications. By way of example, the application illustrated in the drawings is an electrical receptacle assembly 10 for a ground fault circuit interrupt unit or the like.

The electrical receptacle assembly 10 basically includes a two-piece housing 14 having a front cover 16 and a back cover 18. The back cover 18 is separate from and mateable with the front cover 16. When the front and back covers 16, 18 are disposed in a mated relationship with one another as seen in FIG. 13, the housing 14 has a substantially rectangular shape, although other shapes are equally possible, and defines an interior cavity 20 enclosing electrical components. The assembly 10 also includes a mounting bridge 22 which is substantially flat in shape, although other shapes are equally possible, and is sandwiched between the front and back covers 16, 18 of the housing 14 when in an assembled condition. The mounting bridge 22 is provided for attachment of the assembly 10 to any suitable structure, such as a building wall.

Other components of the receptacle assembly 10, which are disposed in the interior cavity 20 of the housing 14 when the front and back covers 16, 18 are in the assembled condition, include a pair of conductor plates 24, 26, an insulative support member 28, and a printed circuitboard 30 with various solid state components making up the ground fault interrupt circuitry. The mounting bridge 22, one conductor plate 26 and support member 28 have screws 32 for connecting thereto the bare ends of respective ground, hot and neutral conductor wires. The mounting bridge 22 and conductor plates 24, 26 also support respective ground, hot and neutral electrical terminals 34, 36, 38 for receiving the corresponding prongs of an electrical plug (not shown). The configuration of the ground electrical terminals 34 comprises the subject matter of the invention claimed in the copending application cross-referenced above. Further detailed description of such electrical terminals 34 is not necessary to be given herein for gaining a clear and thorough understanding of the present invention.

Referring now to FIGS. 1–5 and 13, the front cover 16 of the housing 14 has opposite forward and rearward sides 40, 42, opposite top and bottom end walls 44 and opposite lateral side walls 46, all of which are integrally connected together. The forward side 40 of the front cover 16 defines openings 48 for receiving elements such as pushkeys 50 mounted on the circuitboard 30 disposed in the interior cavity 20 of the housing 14 and apertures 52 for receiving prongs of electrical plugs (not shown) for mating with the aforementioned contact terminals 34, 36, 38. The openings 48 and apertures 52 may have any suitable dimensions. The forward side 40 of the front cover 16 is in the form of a wall which substantially closes the same. On the other hand, the rearward side 42 of the front cover 16 is substantially open.

Referring now to FIGS. 1 and 6–13, the back cover 18 of the housing 14 has opposite forward and rearward sides 54, 56, opposite top and bottom end walls 58 and opposite lateral side walls 60, all of which are integrally connected together. The forward side 54 of the back cover 18 is open, whereas the rearward side 56 of the back cover 18 is in the form of a wall which substantially closes the same. The open forward side 54 of the back cover 18 is adapted to interfit with the open rearward side 42 of front cover 16 to provide them in the mated relationship with one another and with the mounting bridge 22 sandwiched therebetween. The front and back covers 16, 18 of the housing 14 are comprised of a substantially rigid plastic material, but may be made of any other suitable material.

Referring now to FIG. 1, the mounting bridge 22 has a pair of opposite end portions 62 and a middle portion 64 disposed between and interconnected to the pair of opposite end portions 62. Each opposite end portion 62 has a pair of ears 66 for attachment of the assembly 10 to the external structure. Each ear 66 defines an annular hole 68 for receiving a suitable fastener, such as a screw or the like. The mounting bridge 22 is generally securable between the front and back covers 16, 18 of the housing 14 such that the middle portion 64 of the mounting bridge 22 is disposed within the interior cavity 20 defined by the front and back covers 16, 18 of the housing 14 while each of the opposite end portions 62 of the mounting bridge 22 protrudes externally from between the front and back covers 16, 18 of the housing 14. The mounting bridge 22 is comprised substantially of metal, but may be made of any other suitable material.

Referring now to FIGS. 1–16, there is illustrated the plurality of dual snap-fit securement means 12 of the present invention which tightly retain the front and back covers 16, 18 of the housing 14 together in the interfitted mated relationship. More particularly, each dual snap-fit securement means 12 includes a lug 70 and a corresponding pair of latching tabs 72. The lugs 70 of the respective securement means 12 are attached on one of the front and back covers 16, 18 of the housing 14, whereas the pairs of latching tabs 72 are attached on the other of the front and back covers 16, 18 of the housing 14 and disposed in a latching position relative to one another. In the illustrated embodiment, the lugs 70 of the respective securement means 12 are attached on the opposite lateral side walls 60 of the back cover 18, whereas the pairs of latching tabs 72 of the respective securement means 12 are attached on the opposite lateral side walls 46 of the front cover 14. Within the purview of the present invention, this arrangement could be reversed. In the latching position, the latching tabs 72 are adapted to make interlocking engagement with the lug 70 of the corresponding dual snap-fit securement means 12 upon interfitting of the front and back covers 16, 18 of the housing 14 into the mating relationship with one another.

By way of example only as illustrated in drawings, three lugs 70 are provided on each of the opposite lateral side walls 60 of the back cover 18 of the housing 14, while three pairs of latching tabs 72 are provided on each of the opposite lateral side walls 46 of the front cover 16 of the housing 14. The three pairs of latching tabs 72 are provided in alignment and operable with the three lugs 70 of the corresponding three securement means 12 to hold the interfitted front and back covers 16, 18 of the housing 14 in the mating relationship with one another. However, it should be understood that it is within the purview of the present invention that the housing 14 may also have any other suitable number of lugs 70 and pairs of latching tabs 72 making corresponding securement means 12.

Figure 14:
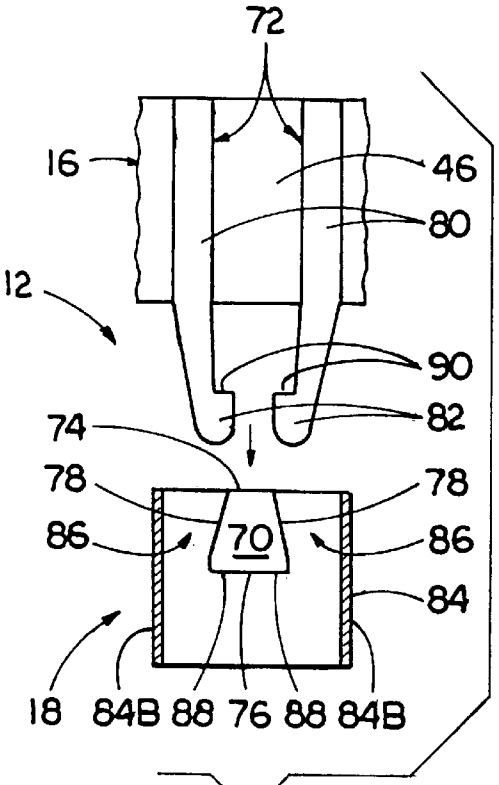

More particularly, each lug 70 has forward and rearward ends 74, 76 and a pair of opposite side surfaces 78 spaced apart and facing away from one another and extending from the first end 74 to the second end 76 of the lug 70. The latching tabs 72 of each pair have respective body portions 80 spaced apart from one another and fixedly attached to respective ones of the opposite lateral side walls 46 of the front cover 16. The body portions 80 of the latching tabs 72 extend outwardly (or rearwardly) from the front cover 16 toward the respective ones of the opposite lateral side walls 60 of the back cover 18. The latching tabs 72 of each pair also have respective outer end portions 82 on the respective body portions 80 which are adapted to interlock with the lug 70 when the front cover 16 is interfitted with the back cover 18. The respective outer end portions 82 of the latching tabs 72 of each pair are aligned with the respective opposite side surfaces 78 of the lug 70 of the corresponding securement means 12 so that the respective outer end portions 82 of the latching tabs 72 will initially engage the opposite side surfaces 78 of the lugs 70 at the forward end 74 thereof as the front and back covers 16, 18 are being interfitted with one another and the latching tabs 72 are making latching engagement with the lug 70. Furthermore, the respective body portions 80 of the latching tabs 72 are resiliently bendable away from the latching position, as shown in FIG. 14, in which the outer end portions 82 of the latching tabs 72 making latching engagement with the lug 70 are spaced apart from one another through a distance shorter than a distance between the opposite side surfaces 78 of the lug 70 at the rearward end 76 thereof.

Referring to FIGS. 6–11 and 14–16, each of the plurality of dual snap-fit securement means 12 also includes a sleeve 84 of generally C-shaped cross-sectional configuration. Each sleeve 84 is attached on one of the opposite lateral side walls 60 of the back cover 18 of the housing 14 adjacent to and surrounding a respective one of the lugs 70. Each sleeve 84 has an outer wall 84A spaced outwardly from the one side wall 60 and attached to the respective one lug 70 and a pair of opposite end flanges 84B extending parallel to one another and between and attached to the one side wall 60 and a pair of opposite edges of the outer wall 84A. The end flanges 84B are spaced outwardly from the opposite side surfaces 78 of the respective one lug 70 so as to define respective guide passages 86 open at opposite ends and extending between the end flanges 84B of the sleeve 84 and the opposite side surfaces 78 of the lug 70 for receiving and guiding the latching tabs 72.

Figure 15:
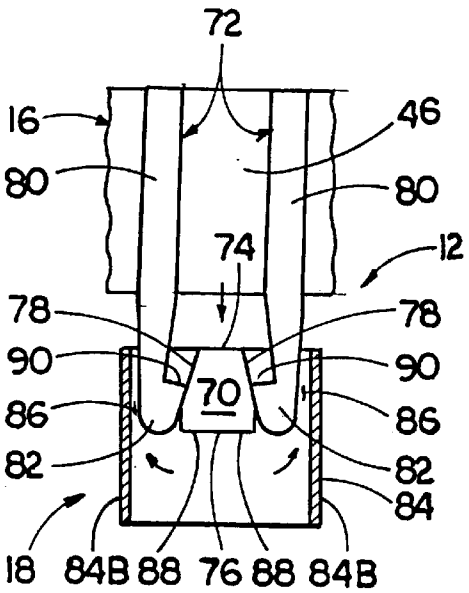

The opposite side surfaces 78 of each lug 70 are closer to one another at the forward end 74 of the lug 70 than at the rearward end 76 thereof such that the opposite side surfaces 78 extend from the forward end 74 to the rearward end 76 of the lug 70 in a diverging relationship which produces camming actions against the respective outer end portions 82 of the latching tabs 72 after the outer end portions 82 have initially engaged the opposite side surfaces 78 of the lug 70 at the forward end thereof as the front and back covers 16, 18 are being interfitted with one another. The camming actions cause the respective body portions 80 of the latching tabs 72 to bend away from one another, as shown in FIG. 15, from the latching position shown in FIG. 14. Such bending of the body portions 80 of the latching tabs 72 causes the respective outer end portions 82 of the latching tabs 72 to spread apart from one another through a distance greater than the distance between the opposite side surfaces 78 of the lug 70 at the rearward end 76 thereof and thereby allow the lug 70 to move between and past the respective outer end portions 82 of the latching tabs 72 toward the front cover 16 as the front and back covers 16, 18 are being interfitted in the mating relationship with one another.

Figure 16:
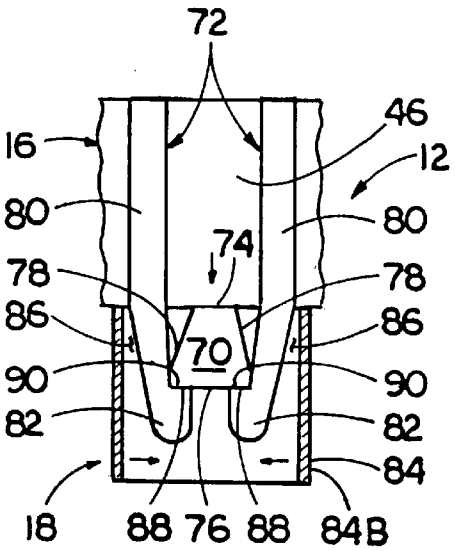
FIGS. 14–16 are diagrammatic views showing the operation of a lug and pair of latching tabs of one of the plurality of dual snap-fit securement means of the electrical receptacle assembly.

Also, the lug 70 has respective ledges 88 provided at the rearward end 76 thereof extending transversely to the adjacent opposite side surfaces 78 thereof. The respective outer end portions 82 of the latching tabs 72 have respective latching surfaces 90 thereon which are brought into an overlapping relationship with the respective ledges 88 of the lug 70 to provide the interlocking relationship of the latching tabs 72 with the lug 70 as the respective outer end portions 82 of the latching tabs 72 return to the latching position once the lug 70 has moved past the respective outer end portions 82 of the latching tabs 72, as seen in FIG. 16, as the front and back covers 16, 18 are interfitted in the mating relationship with one another. The plurality of dual snap-fit securement means 12 of the present invention having the above-defined constructions allow the front and back covers 16, 18 to be tightly retained together in the tight-fitting mated relationship.

Figure 4:
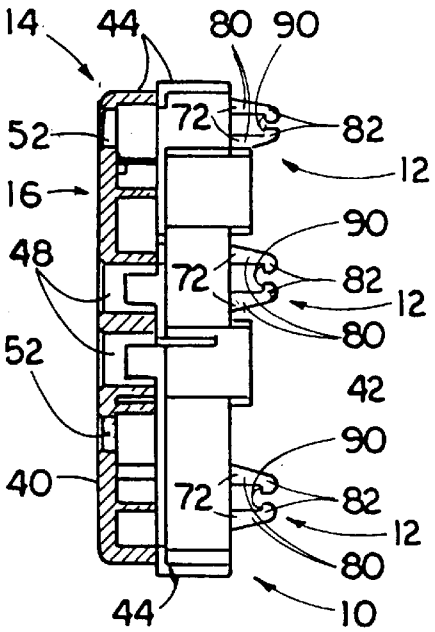
FIG. 4 is a longitudinal sectional view of the front cover of the housing taken along lines 4—4 of FIG. 2.
Figure 2:
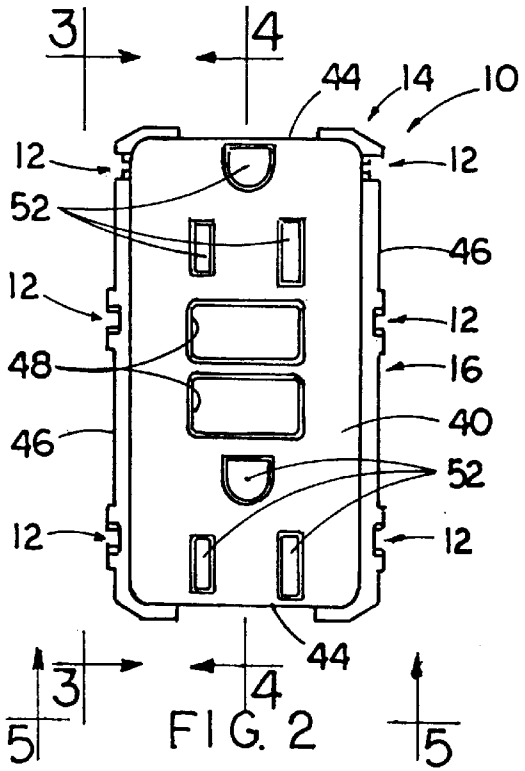
FIG. 2 is an enlarged front plan view of a front cover of a housing of the electrical receptacle assembly of FIG. 1.
Figure 5:
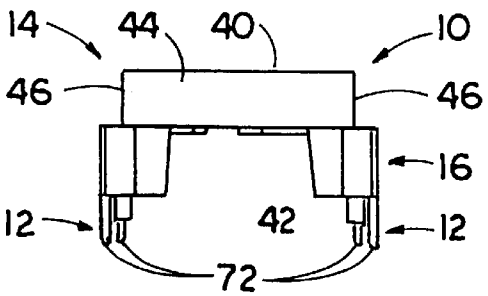
FIG. 5 is an end plan view of the front cover of the housing taken along lines 5—5 of FIG. 2.
Figure 3:
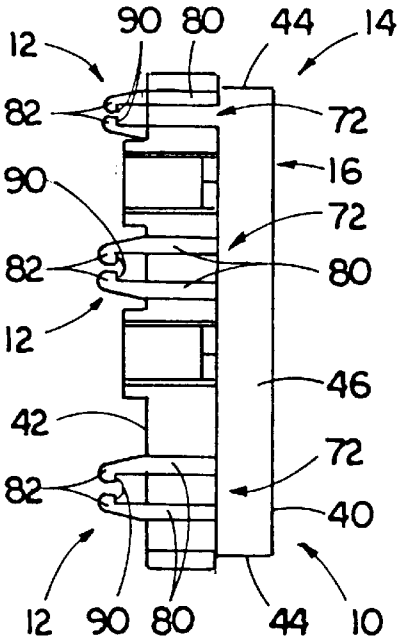
FIG. 3 is a side elevational view of the front cover of the housing taken along lines 3—3 of FIG. 2.
Figure 8:
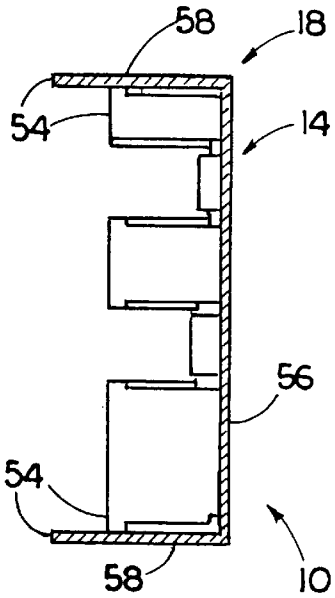
FIG. 8 is a longitudinal sectional view of the back cover of the housing taken along lines 8—8 of FIG. 6.
Figure 6:
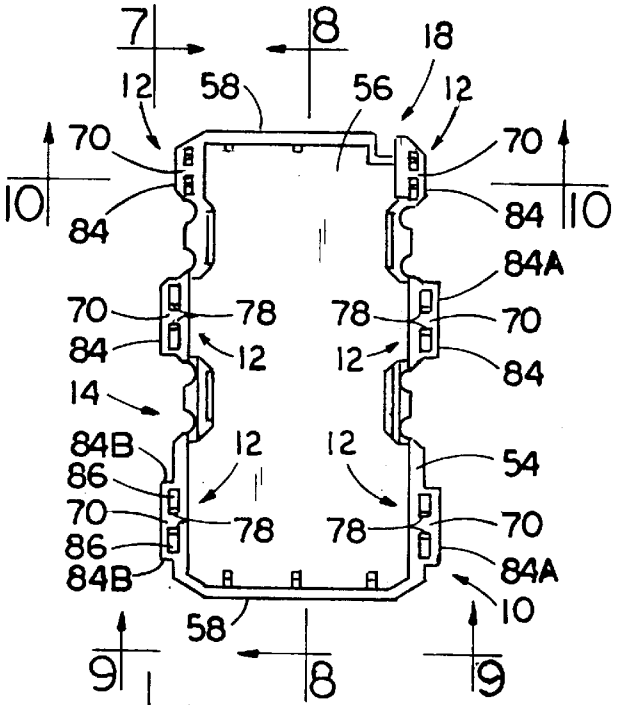
FIG. 6 is an enlarged front plan view of a back cover of the housing of the electrical receptacle assembly of FIG. 1.
Figure 9:
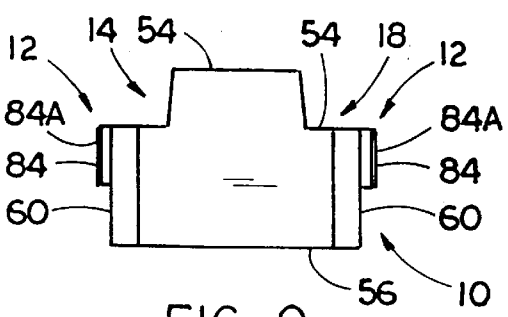
FIG. 9 is an end plan view of the back cover of the housing taken along lines 9—9 of FIG. 6.
Figure 7:
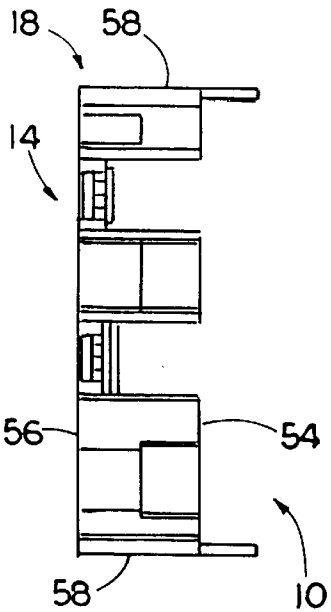
FIG. 7 is a side elevational view of the back cover of the housing taken along lines 7—7 of FIG. 6.
Figure 10:
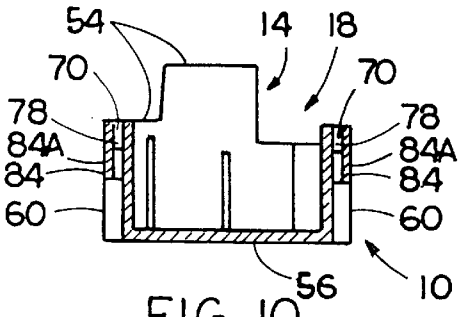
FIG. 10 is a transverse sectional view of the back cover of the housing taken along lines 10—10 of FIG. 6.
Figure 12:
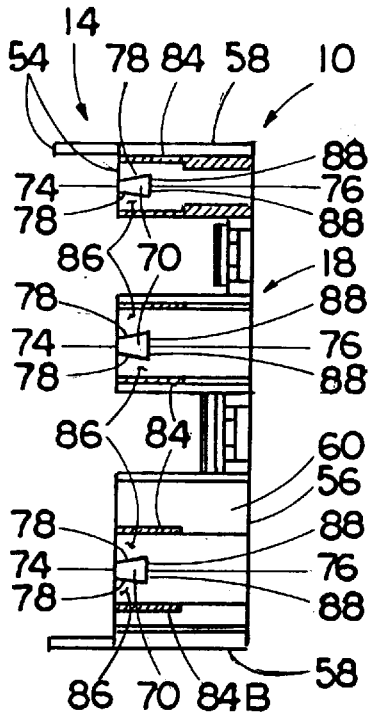
FIG. 12 is a side elevational view of the back cover of the housing taken along lines 12—12 of FIG. 11 with portions of the dual snap-fit securement means on the back cover being broken away.
Figure 11:
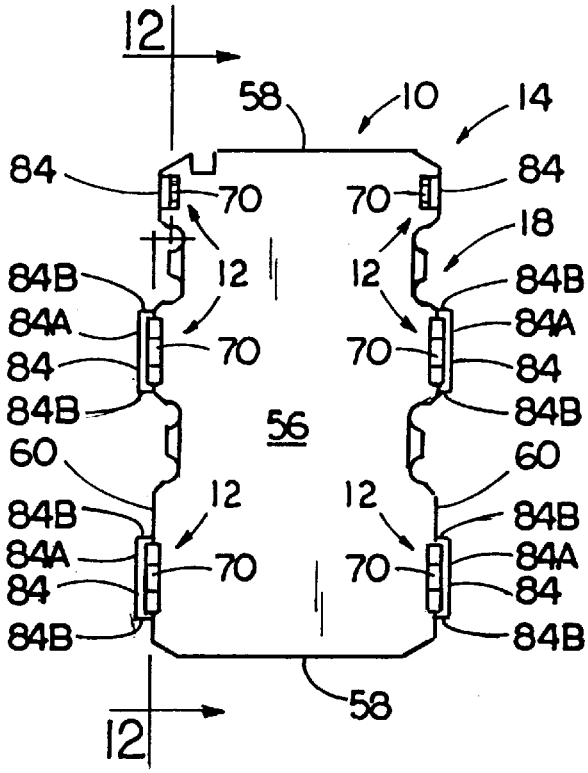
FIG. 11 is a rear plan view of the back cover of the housing of FIG. 6.

Additionally, as seen in FIGS. 3, 4 and 12, at least one pair of latching tabs 72 of the plurality of dual snap-fit securement means 12 is different in size than another pair of the latching tabs 72 of the plurality of dual snap-fit securement means 12. At least one lug 70 of the plurality of dual snap-fit securement means 12 is different in size than another lug 70 of the plurality of dual snap-fit securement means 12.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

We claim:

1. An electrical receptacle assembly, comprising:

(a) a housing including (i) a front cover, and (ii) a back cover being adapted to interfit with said front cover in a mating relationship so as to define an interior cavity for enclosing electrical components; and (b) a plurality of dual snap-fit securement means provided on said housing, each of said dual snap-fit securement means of said plurality thereof including (i) a lug attached on one of said front and back covers of said housing, said lug having first an second ends and a pair of opposite side surfaces spaced apart and facing away from one another and extending from said first end of said second end of said lug, and (ii) a pair of latching tabs attached on the other of said front and back covers of said housing and disposed in a latching position relative to one another in which said latching tabs are adapted to make interlocking engagement with said lug upon interfitting of said front and back covers into said mating relationship with one another, said latching tabs including respective body portions fixedly attached to said other of said front and back covers and extending outwardly therefrom toward said lug on said one of said front and back covers; and respective outer end portions on said respective body portions adapted to interlock with said lug when said one of said front and back covers is interfitted with said other of said front and back covers, said respective outer end portions of said latching tabs being aligned with respective ones of said opposite side surfaces of said lug so that said respective outer end portions of said latching tabs will initially engage said opposite side surfaces of said lug at said first end thereof as said front and back covers are being interfitted with one another, and said latching tabs making latching engagement with said lug when said front and back covers are mated together.

2. The assembly as recited in claim 1, wherein at least one pair of said latching tabs of said plurality of dual snap-fit securement means is different is size than another pair of said latching tabs of said plurality of dual snap-fit securement means.

3. The assembly as recited in claim 1, wherein at least one lug of said plurality of dual snap-fit securement means is different in size than another lug of said plurality of dual snap-fit securement means.

4. The assembly as recited in claim 1, wherein said respective body portions of said latching tabs are resiliently bendable away from said latching position in which said outer end portions of said latching tabs making latching engagement with said lug are spaced apart from one another through a distance shorter than a distance between said opposite side surfaces of said lug at said second end thereof.

5. The assembly as recited in claim 4, wherein said opposite side surfaces of said lug are closer to one another at said first end of said lug than at said second end thereof such that said opposite side surfaces of said lug extend from said first end to said second end of said lug in a diverging relationship which produces camming actions against said respective outer end portions of said latching tabs after said outer end portions initially engage said opposite side surfaces of said lug at said first end thereof as said front and back covers are being interfitted with one another, said camming actions causing said respective body portions of said latching tabs to bend away from one another and said respective outer end portions thereof to spread apart from one another through a distance greater than said distance between said opposite side surfaces of said lug at said second end thereof and thereby allow said lug to move between and past said respective outer end portions of said latching tabs toward said other of said front and back covers as said front and back covers are being interfitted in said mating relationship with one another.

6. The assembly as recited in claim 5, wherein:

said lug has respective ledges provided at said second end thereof extending transversely to said opposite side surfaces thereof; and said respective outer end portions of said latching tabs have respective latching surfaces thereon which are brought into an overlapping relationship with said respective ledges of said lug to provide said interlocking relationship of said latching tabs with said lug as said respective outer end portions of said latching tabs return to said latching position once said lug has moved past said respective outer end portions of said latching tabs as said front and back covers are interfitted in said mating relationship with one another.

7. An electrical receptacle assembly, comprising:

(a) a housing including (i) a front cover, and (ii) a back cover being adapted to interfit with said front cover in a mating relationship so as to define an interior cavity for enclosing electrical components; and (b) a plurality of dual snap-fit securement means provided on said housing, each of said dual snap-fit securement means of said plurality thereof including (i) a lug attached one of said front and back covers of said housing, (ii) a pair of latching tabs attached on the other of said front and back covers of said housing and disposed in a latching position relative to one another in which said latching tabs are adapted to make interlocking engagement with said lug upon interfitting of said front and back covers into said mating relationship with one another, and (iii) a sleeve attached on said one of said front and back covers of said housing and surrounding said lug and spaced outwardly from said side surfaces thereof so as to define respective guide passages adjacent to said opposite side surfaces for receiving said latching tabs.

8. An electrical receptacle assembly, comprising:

(a) a housing including (i) a front over having opposite forward and rearward sides, opposite top and bottom end walls and opposite lateral side walls all being connected to one another, and (ii) a back over having opposite forward and rearward sides, opposite top and bottom end walls and opposite lateral side walls all being connected to one another, said back cover at said forward side thereof being adapted to interfit with said front cover at said rearward side thereof in a mating relationship so as to define an interior cavity for enclosing electrical components; and (b) a plurality of dual snap-fit securement means provided on said housing, each of said dual snap-fit securement means of said plurality thereof including (i) a lug attached on a respective one of said opposite lateral side walls of said back cover of said housing, said lug having first and second ends and a pair of opposite side surfaces spaced apart and facing away from one another and extending from said first end to said second end of said lug, and (ii) a pair of latching tabs attached on a respective one of said opposite lateral side walls of said front cover of said housing, said latching tabs of said pair being disposed in a latching position relative to one another in which said latching tabs are adapted to make interlocking engagement with said lug upon interfitting of said front and back covers into said mating relationship with one another, said latching tabs including respective body portions fixedly attached to said respective one of said opposite lateral side walls of said front cover of said housing and extending outwardly therefrom toward said lug on said respective one of said opposite lateral side walls of said back cover; and respective outer end portions on said respective body portions adapted to interlock with said lug when said front cover is interfitted with said back cover, said respective outer end portions of said latching tabs being aligned with respective ones of said opposite side surfaces of said lug so that said respective outer end portions of said latching tabs will initially engage said opposite side surfaces of said lug at said first end thereof as said front and back covers are being interfitted with one another, and said latching tabs making latching engagement with said lug when said front and back covers are mated together.

9. The assembly as recited in claim 8, wherein at least one pair of said latching tabs of said plurality of dual snap-fit securement means is different in size than another pair of said latching tabs of said plurality of dual snap-fit securement means.

10. The assembly as recited in claim 8, wherein at least one lug of said plurality of dual snap-fit securement means is different in size than another lug of said plurality of dual snap-fit securement means.

11. The assembly as recited in claim 8, wherein said respective body portions of said latching tabs are resiliently bendable away from said latching position in which said outer end portions of said latching tabs making latching engagement with said lug are spaced apart from one another through a distance shorter than a distance between said opposite side surfaces of said lug at said second end thereof.

12. The assembly as recited in claim 11, wherein said opposite side surfaces of said lug are closer to one another at said first end of said lug than at said second end thereof such that said opposite side surfaces of said lug extend from said first end to said second end of said lug in a diverging relationship which produces camming actions against said respective outer end portions of said latching tabs after said outer end portions initially engage said opposite side surfaces of said lugs at said first end thereof as said front and back covers are being interfitted with one another, said camming actions causing said respective body portions of said latching tabs to bend away from one another and said respective outer end portions thereof to spread apart from one another through a distance greater than said distance between said opposite side surfaces of said lug at said second end thereof and thereby allow said lug to move between and past said respective outer end portions of said latching tabs toward said front cover as said front and back covers are being interfitted in said mating relationship with one another.

13. The assembly as recited in claim 12, wherein:

said lug has respective ledges provided at said second end thereof extending transversely to said opposite side surfaces thereof; and said respective outer end portions of said latching tabs have respective latching surfaces thereon which are brought into an overlapping relationship with said respective ledges of said lug to provide said interlocking relationship of said latching tabs with said lug as said respective outer end portions of said latching tabs return to said latching position once said lug has moved past said respective outer end portions of said latching tabs as said front and back covers are interfitted in said mating relationship with one another.

14. An electrical receptacle assembly, comprising:

(a) a housing including (i) a front cover having opposite forward and rearward sides, opposite top and bottom end walls and opposite lateral side walls all being connected to one another, and (ii) a back cover having opposite forward and rearward sides, opposite top and bottom end walls and opposite lateral side walls all being connected to one another, said back cover at said forward side thereof being adapted to interfit with said front cover at said rearward side thereof in a mating relationship so as to define an interior cavity for enclosing electrical components; and (b) a plurality of dual snap-fit securement means provided on said housing, each of said dual snap-fit securement means of said plurality thereof including (i) a lug attached on a respective one of said opposite lateral side walls of said back cover of said housing, (ii) a pair of latching tabs attached on a respective one of said opposite lateral side walls of said front cover of said housing, said latching tabs of said pair being disposed in a latching position relative to one another in which said latching tabs are adapted to make interlocking engagement with said lug upon interfitting of said front and back covers into said mating relationship with one another, and (iii) a sleeve attached on said back cover of said housing surrounding said lug and spaced outwardly from said opposite side surfaces thereof so as to define respective guide passages adjacent to said opposite side surfaces of said lug for receiving said latching tabs.

15. The assembly as recited in claim 8, wherein each of said opposite lateral side walls of said back cover supports three lugs of said plurality of securement means.

16. The assembly as recited in claim 15, wherein each of said opposite lateral side walls of said front cover supports three pairs of said latching tabs for alignment and interlocking engagement with said three lugs supported on each of said opposite lateral side walls of the back cover.

* * * * *